US011377927B2

(12) United States Patent
Ruckert

(10) Patent No.: US 11,377,927 B2
(45) Date of Patent: Jul. 5, 2022

(54) METHOD OF REMEDIATING LEAKS IN A CEMENT SHEATH SURROUNDING A WELLBORE TUBULAR

(71) Applicant: SHELL OIL COMPANY, Houston, TX (US)

(72) Inventor: Frank Ruckert, Rijswijk (NL)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/261,266

(22) PCT Filed: Jul. 15, 2019

(86) PCT No.: PCT/EP2019/068984

§ 371 (c)(1),
(2) Date: Jan. 19, 2021

(87) PCT Pub. No.: WO2020/016169

PCT Pub. Date: Jan. 23, 2020

(65) Prior Publication Data

US 2021/0348473 A1 Nov. 11, 2021

(30) Foreign Application Priority Data

Jul. 20, 2018 (EP) ..... 18184687

(51) Int. Cl.
*E21B 33/14* (2006.01)
*E21B 47/005* (2012.01)
(Continued)

(52) U.S. Cl.
CPC ..... *E21B 33/14* (2013.01); *E21B 43/103* (2013.01); *E21B 43/117* (2013.01); *E21B 47/005* (2020.05)

(58) Field of Classification Search
CPC ..... E21B 33/14; E21B 47/005; E21B 43/103; E21B 43/117
See application file for complete search history.

(56) References Cited

U.S. PATENT DOCUMENTS 3,045,753 A 7/1962 Goodwin
3,167,122 A 1/1965 Lang
(Continued)

FOREIGN PATENT DOCUMENTS

CN 1711407 A 12/2005
CN 101718189 A 6/2010
(Continued)

OTHER PUBLICATIONS

International Search Report and Written Opinion received for PCT Application No. PCT/EP2019/068984, dated Sep. 23, 2019, 09 pages.

(Continued)

*Primary Examiner* — Yong-Suk (Philip) Ro
(74) *Attorney, Agent, or Firm* — Shell USA, Inc.

(57) ABSTRACT

An energetics device is employed to create an outwardly directed pressure wave at a selected depth within a wellbore tubular cemented into a wellbore. The pressure wave causes the wellbore tubular to plastically deform at the selected depth. This locally expands the wellbore tubular at the selected depth, whereby a circumferential recess is created into an inner surface of the wellbore tubular and whereby the outer surface of the wellbore tubular is forced into the surrounding cement sheath at the selected depth. Microcavities and/or micro annuli in the impacted zone may be sealed as a result.

10 Claims, 3 Drawing Sheets

(51) Int. Cl.
*E21B 43/10* (2006.01)
*E21B 43/117* (2006.01)

(56) References Cited

U.S. PATENT DOCUMENTS

| | | | |
|---|---|---|---|
| 3,477,506 | A | 11/1969 | Malone |
| 3,720,262 | A | 3/1973 | Grable |
| 3,857,445 | A | 12/1974 | Mower |
| 4,407,365 | A | 10/1983 | Cooke, Jr. |
| 4,716,965 | A | 1/1988 | Bol et al. |
| 5,348,095 | A | 9/1994 | Worrall et al. |
| 6,135,208 | A | 10/2000 | Gana et al. |
| 6,419,025 | B1 | 7/2002 | Lohbeck et al. |
| 6,446,323 | B1 | 9/2002 | Metcalfe et al. |
| 6,497,289 | B1 | 12/2002 | Lance et al. |
| 6,702,030 | B2 | 3/2004 | Simpson |
| 6,725,917 | B2 | 4/2004 | Metcalfe |
| 7,124,826 | B2 | 10/2006 | Simpson |
| 7,350,584 | B2 | 4/2008 | Simpson et al. |
| 7,527,099 | B2 | 5/2009 | Bosma et al. |
| 7,762,342 | B2 | 7/2010 | Richard et al. |
| 7,861,783 | B2 | 1/2011 | Baaijens et al. |
| 10,329,869 | B2 | 6/2019 | Kunz |
| 10,794,158 | B2 | 10/2020 | Cornelissen |
| 2002/0033261 | A1 | 3/2002 | Metcalfe |
| 2005/0072569 | A1 | 4/2005 | Johnston et al. |
| 2006/0000617 | A1 | 1/2006 | Harrall et al. |
| 2006/0124295 | A1 | 6/2006 | Maguire |
| 2006/0191691 | A1 | 8/2006 | Lohbeck |
| 2006/0243452 | A1 | 11/2006 | Eckerlin |
| 2006/0254778 | A1 | 11/2006 | Nobileau |
| 2008/0149346 | A1 | 6/2008 | Bosma et al. |
| 2008/0223568 | A1 | 9/2008 | Roggeband et al. |
| 2010/0132952 | A1 | 6/2010 | Nicolas et al. |
| 2010/0319427 | A1 | 12/2010 | Lohbeck |
| 2012/0018154 | A1 | 1/2012 | James |
| 2012/0061078 | A1 | 3/2012 | Algu et al. |
| 2012/0145381 | A1 | 6/2012 | Nobileau |
| 2016/0010423 | A1 | 1/2016 | Myhre et al. |
| 2016/0115764 | A1 | 4/2016 | Farley |
| 2016/0362968 | A1 | 12/2016 | Kriesels et al. |
| 2017/0335673 | A1 | 11/2017 | Burke et al. |
| 2010/8066489 | | 3/2018 | Pipchuk et al. |
| 2019/0040721 | A1 | 2/2019 | Kohn et al. |
| 2020/0040714 | A1 | 2/2020 | Surjaatmadja et al. |

FOREIGN PATENT DOCUMENTS

| | | | | |
|---|---|---|---|---|
| WO | 2015066804 | A1 | 5/2015 | |
| WO | 2015117223 | A1 | 8/2015 | |
| WO | WO-2018083069 | A1 * | 5/2018 | ..... E21B 33/13 |

OTHER PUBLICATIONS

Kunz, Winterhawk Well Abandonment Technical Information Presentation presented on Sep. 25, 2017 ,16 pages.

Imran et al., "Experimental Study of Plain Concrete under Triaxial Stress" ACI Materials Journal, vol. 93, Issue No. 6, 1996, pp. 589-601.

Kupresan et al., "Experimental Assessment of Casing Expansion as a Solution to Microannular Gas Migration", IADC/SPE 168056, Mar. 4-6, 2014, 11 pages.

* cited by examiner

METHOD OF REMEDIATING LEAKS IN A CEMENT SHEATH SURROUNDING A WELLBORE TUBULAR

CROSS REFERENCE TO RELATED APPLICATIONS

This is a national stage application on International application No. PCT/EP2019/068984, filed 15 Jul. 2019, which claims priority of European application No. 18184687.4, filed 20 Jul. 2018.

FIELD OF THE INVENTION

In one aspect, the present invention relates to a method of remediating leaks in a cement sheath of cured cement surrounding a wellbore tubular in an underground wellbore. In another aspect, the present invention may relate to a method of sealing cavities in or adjacent to a cement sheath of cured cement surrounding a wellbore tubular in an underground wellbore.

BACKGROUND OF THE INVENTION

Wellbore tubulars such as casing are well known in the oil and gas industry. Such casing is traditionally cemented into underground wellbores, whereby the cement functions to provide an annular seal between the casing and the surrounding formation rock or between an inner wellbore tubular and an outer wellbore tubular which is concentrically or eccentrically arranged around the inner wellbore tubular. A known problem is that small cracks (such as microcavities) may form in the cement sheath surrounding the wellbore tubular or between the cement sheath and the tubular or the surrounding formation rock (known as micro-annuli). Such microcavities and micro-annuli may result in unacceptable surface casing vent flow, which is of concern in the industry.

A method and tool to seal such (micro-)cavities in or adjacent to a cement sheath is described in International publication WO 2018/083069 A1. The described tool comprises an expansion device that can be moved up and down the wellbore tubular to a desired location. The device is equipped with a hydraulic actuation assembly that radially expands and contracts expansion segments arranged around a circumference of the tool. At the desired location, the expansion segments are pressed into the inner surface of the wellbore tubular wherein circumferentially spaced recesses are pressed into the inner surface. The outer surface of the wellbore tubular is thereby locally expanded into the surrounding cement sheath and the cavities and/or micro annuli are sealed.

It has been found that hardened cement exhibits plastic deformation under the stress imposed by the local expansion of the selected casing section into the cement sheath. As a result of the plastic deformation, cavities and micro annuli may disappear or reduce.

The tool of WO 2018/083069 A1 has mechanical parts, and it may be challenging to fit this tool into smaller diameter tubulars.

SUMMARY OF THE INVENTION

The invention provides a method of remediating leaks in a cement sheath of cured cement surrounding a wellbore tubular in an underground wellbore, the method comprising the steps of:

providing an energetics device comprising at least one charge;

moving the energetics device to a selected depth in the wellbore tubular; and detonating the at least one charge to create an outwardly directed pressure wave over a full 360 radiation angle in a plane transverse to a longitudinal axis of the wellbore tubular at the location of the energetics device;

plastically deforming the wellbore tubular with the pressure wave at the selected depth thereby forming a circumferential recess into an inner surface of the wellbore tubular whereby forcing the outer surface of the wellbore tubular at the selected depth into the surrounding cement sheath.

BRIEF DESCRIPTION OF THE DRAWING

The appended drawing, which is non-limiting, comprises the following figures.

DETAILED DESCRIPTION OF THE INVENTION

The invention will be further illustrated hereinafter by way of example only, and with reference to the non-limiting drawing. The person skilled in the art will readily understand that, while the invention is illustrated making reference to one or more specific combinations of features and measures, many of those features and measures are functionally independent from other features and measures such that they can be equally or similarly applied independently in other embodiments or combinations.

The presently proposed method employs an energetics device to create an outwardly directed pressure wave within the wellbore tubular, to thereby plastically deform the wellbore tubular with the pressure wave at the selected depth. This locally expands the wellbore tubular at a selected depth, whereby a circumferential recess is created into an inner surface of the wellbore tubular and whereby the outer surface of the wellbore tubular is forced into the surrounding cement sheath at the selected depth, thereby sealing (micro-) cavities and/or micro annuli.

It has surprisingly been found that, with the local wellbore tubular expansion caused by detonation of an energetic charge within the wellbore tubular, leak rates through the cement-filled annulus around the wellbore tubular were drastically reduced. Even a single detonation of an energetic charge in a single confined location within the wellbore has been shown to be capable of drastically reducing leak rates through the cement-filled annulus around the wellbore tubular. This came as a surprise, as the deformation rate of the wellbore tubular driven by a pressure wave, is expected to be much higher than the deformation rate that is induced by the hydraulically driven local expander tool as described in WO 2018/083069 A1. It was not expected that the cement in the cement sheath would have time to become plastic under the strain, and reset.

An energetics tool may be designed smaller than a hydraulically activated mechanical tool with moving parts. Typical energetics tools, such as those on the market from W. T. Bell International Inc., are disposable tools and require less capital investment and maintenance than a mechanical tool.

Figure 1:
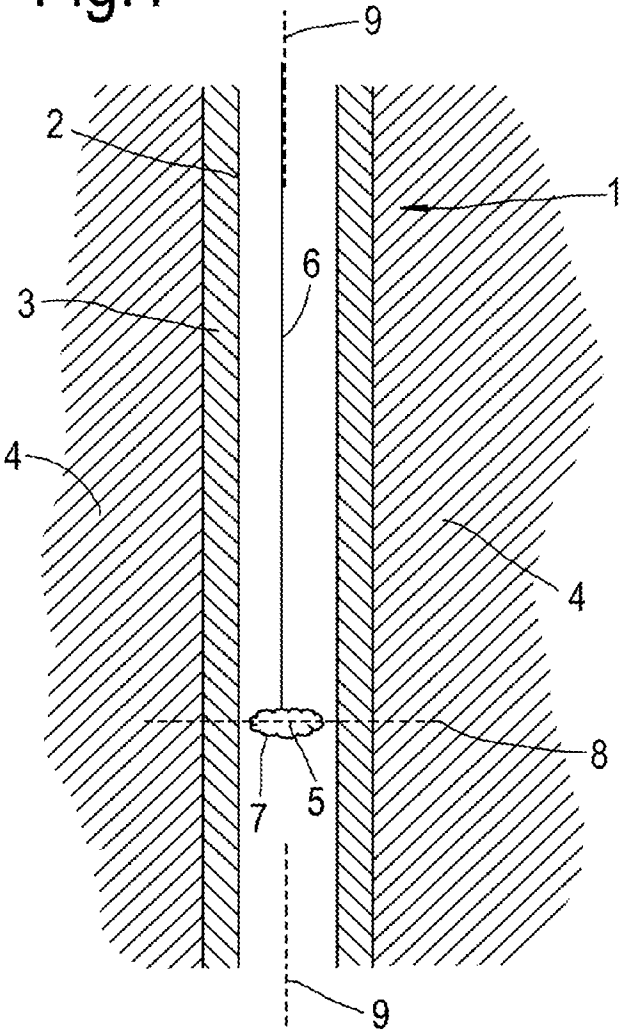
FIG. 1 schematically shows a cross section of an underground wellbore in which at least one energetic charge is detonated.

FIG. 1 schematically shows a cross section of an underground wellbore 1 comprising a wellbore tubular 2. In this example, the wellbore tubular 2 may be referred to as a casing but the invention is not limited to casing. The casing is cemented in place in the underground wellbore 1 using a cement sheath 3 which fills up an annulus around the casing 2 between the casing 2 and the underground formation 4. The cement sheath 3 essentially consists of cured cement surrounding the wellbore tubular 2.

An energetics device 5 is lowered into the wellbore tubular 2, suitably on a wireline 6. While the wireline is generally a convenient and low-cost option to move the energetics device 5 through the wellbore tubular 2, the invention is not necessarily limited to wireline. The energetics device 5 has been moved to a selected depth in the wellbore tubular 2.

The energetics device 5 comprises at least one charge, which is capable of inducing a pressure wave in the wellbore tubular upon detonation. FIG. 1 shows the energetics device 5 just after detonating the energetics charge. The outwardly directed pressure wave 7 extends over a full 360° radiation angle in a plane 8 transverse to a longitudinal axis 9 of the wellbore tubular 2 at the location of the energetics device. The impact of the pressure wave 7 on the wellbore tubular causes a locally straining of the wellbore tubular to above its yield point, but below its rupture point. This results in a circumferential plastic deformation of the wellbore tubular locally at the selected depth. This may be referred to as a local expansion of the wellbore tubular 2.

Figure 2:
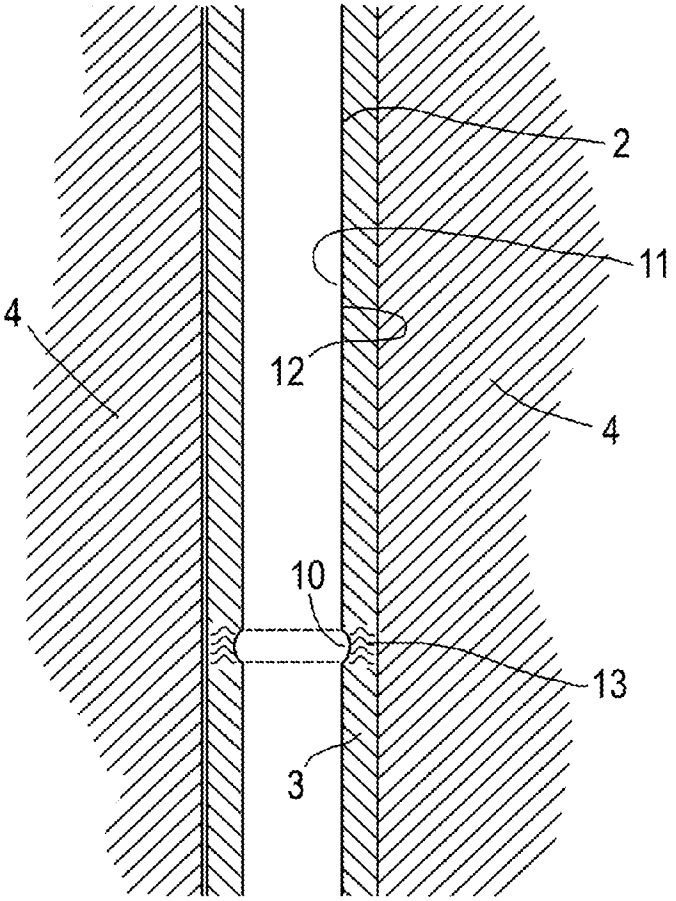
FIG. 2 schematically shows the underground wellbore of FIG. 1 after the wellbore tubular has been locally expanded.

FIG. 2 shows the same wellbore tubular 2 of FIG. 1, after it has been plastically deformed at the selected depth as a direct result of the pressure wave. A circumferential recess 10 has formed into an inner surface 11 of the wellbore tubular 2. The outer surface 12 of the wellbore tubular has been deformed into the surrounding cement sheath 3, thereby sealing any cavities which may have been present in or adjacent to the cement sheath. In an impacted zone 13 directly behind the wellbore tubular 2 the cement has plastically deformed and reset in a more compact state than the cement in the cement sheath outside the impacted zone 13.

The energetics charge preferably creates a preferentially directed pressure wave, characterized by a radiation pattern which is centered around the plane 8 and decreases with latitudinal angle. The latitudinal angle ("latitude") is defined relative to the plane 8 as function of polar angle. Thus, the latitude of the longitudinal direction is 90°, which can be upward or downward. In-plane directed pressure waves have latitude of 0°. Such directivity can be achieved by use of shaped charge technologies, which are known in the art.

The wellbore tubular is preferably cemented into a support structure. The support structure, at least at the selected depth, circumferentially encloses the wellbore tubular in which the energetics device is brought. Examples of the support structure include formation rock, cement, or another wellbore tubular, such as an outer casing. The support structure helps to confine the cement in the cement sheath and thus helps to bring the cement under triaxial load during the local expansion of the wellbore tubular at the selected depth.

The wellbore tubular may be a casing that extends longitudinally through another casing, and at least at the selected depth it is cemented in place against the other casing. The other casing may also be cemented in place, for example against the formation rock. Remediation of leak paths may be accomplished in first annulus between the tubular and the support structure and/or in a second (cemented) annulus behind the first support structure supported by a second support structure.

The sealing effect brought about by the energetics device has been demonstrated in a laboratory test, using a test cell designed to emulate a full-scale well section with a length of 1.3 m. For the test, a 4.5" casing section having an outer diameter of 11.43 cm was cemented inside a 7" casing section having an outer diameter of 11.78 cm, using a Portland Class-G cement. A water/cement ratio of 0.44 was used. The curing time of the cement was adjusted by adding Haliburton HR-4 Retarder. Cement was mixed using a peddle mixer for 15 minutes prior of pumping it in to the cell. The mixture was optimized to stay pumpable at temperature for 8 hours. The sample was cured at constant pressure (100 bar N2) and temperature (80° C.) for 3 days. Inflow required to keep the cell at 100 bar pressure was measured using mass flow meters. The inflow rate peaked at 12 hours after placement of the slurry, which is indicative of shrinkage of the cement during the curing.

Figure 3:
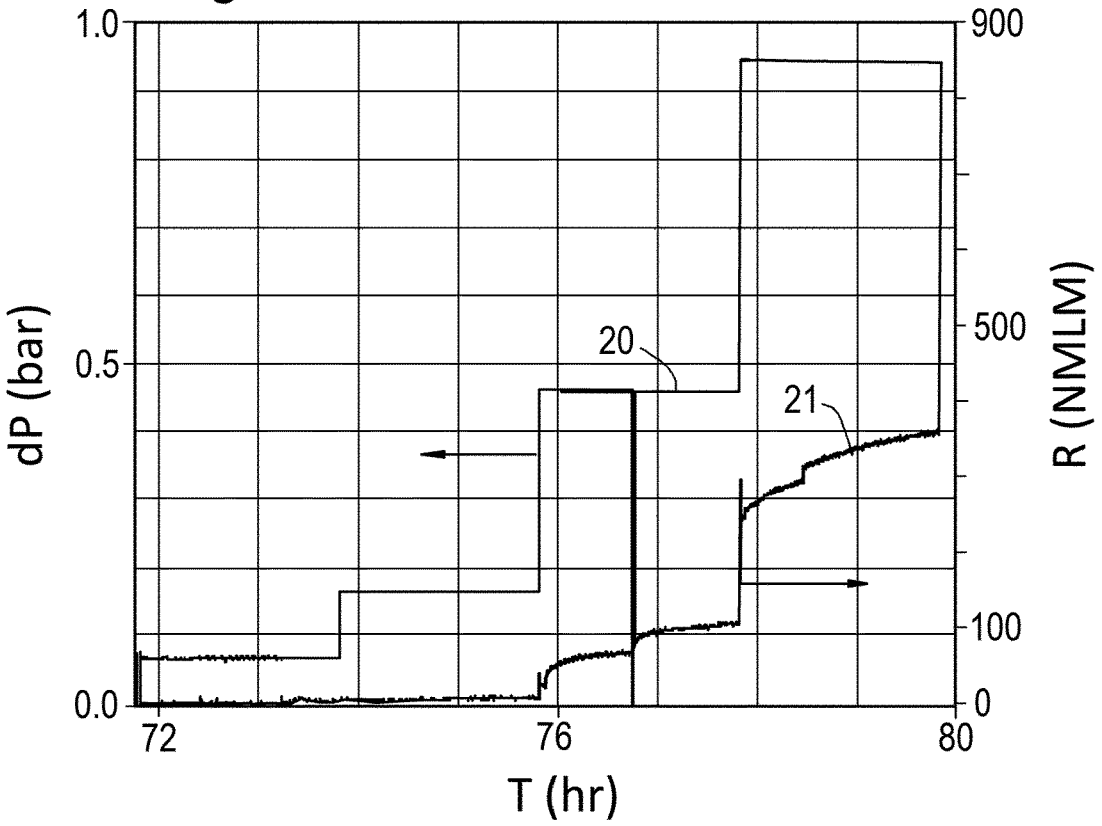
FIG. 3 shows a graphic representation of a reference leak test before inducing the local expansion.

FIG. 3 shows the result of a seal test which represents a reference. The test was conducted using two pressure controllers and a couple of mass flow sensors. During the test, the pressure of N2 to which one end the sample was exposed was kept constant at 100 bar. A pressure differential was then applied to the other end of the sample, while the N2 flow rate R (represented by curve 21), needed to keep the pressure constant at the first end constant, was measured as the differential pressure dP (represented by curve 20) was stepwise increased over time T. Flow was first observed after increasing the differential pressure to approximately 0.5 bar.

Energetic expansion was then applied by W. T. Bell International Inc. (Huntsville, Tex.) upon Applicant's request. The sample was kept at 100 bar pressure and ambient temperature (about 25° C.), and a single local annular expansion was produced. Seal tests were then performed using the same methodology as described above for the reference.

Figure 4:
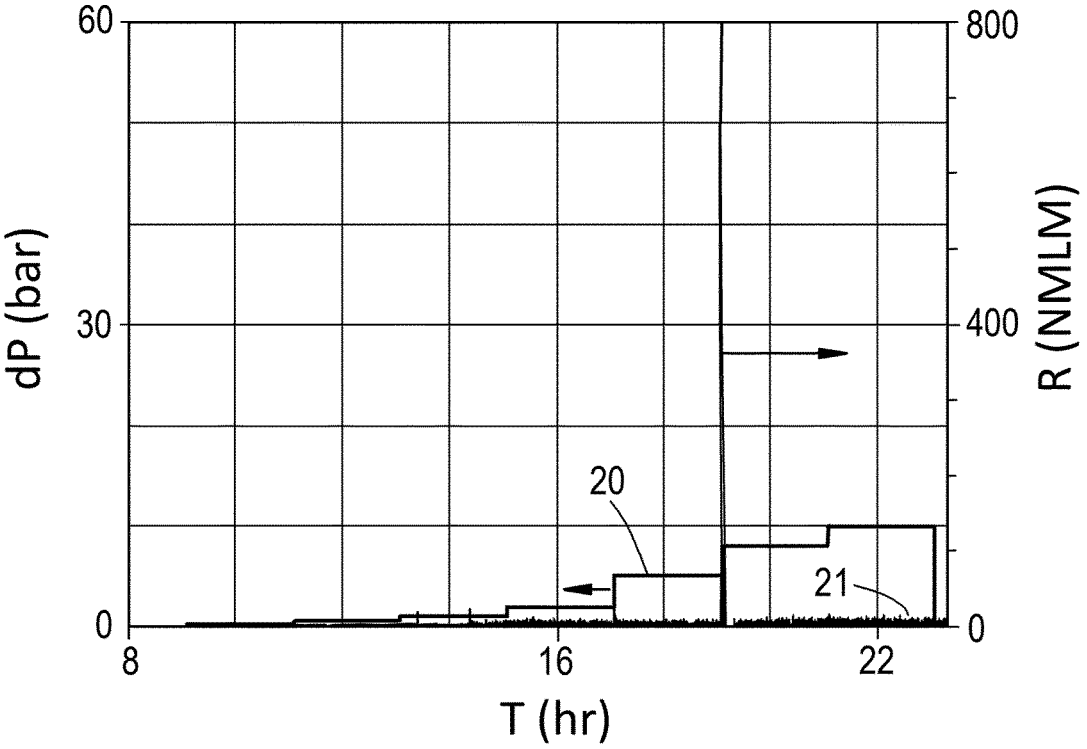
FIG. 4 shows a graphic representation of a leak test at 10 bars, after inducing the local expansion.
Figure 5:
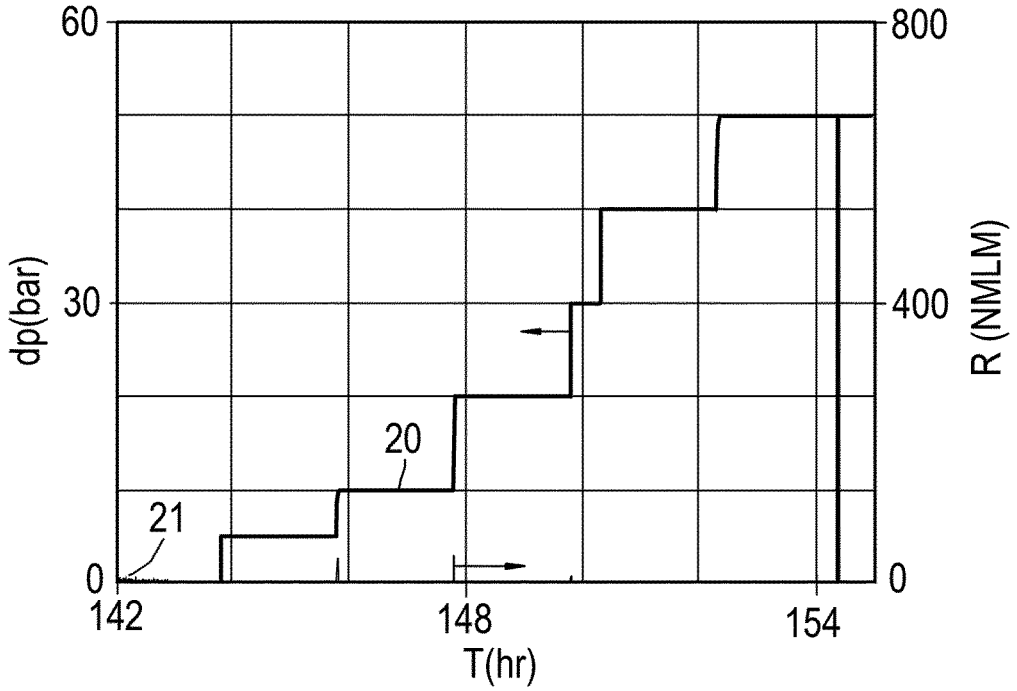
FIG. 5 shows a graphic representation of a leak test at 50 bars, after inducing the local expansion.

FIG. 4 shows the result an absolute pressure of 10 bar. As with FIG. 3, curve 20 shows the pressure differential dP applied while curve 21 represents the flow rate of N2 needed to keep the pressure at the low pressure end at 10 bar. The result shows a gas tight performance, which is underlined by the high dP and low flow rates compared to the reference in FIG. 3. The flow rate peak during the pressure increase to 8 bar differential pressure is an artefact caused by movement of the entire cemented pipe section in the cell, where by the sample shifted a few mm upwards in to the top flange as a result of the relatively high dP applied. The leak test was repeated with the same sample, but at an absolute pressure of 50 bar. The sample was found to be gas tight up to the maximum applied dP of 50 bar.

Figure 6:
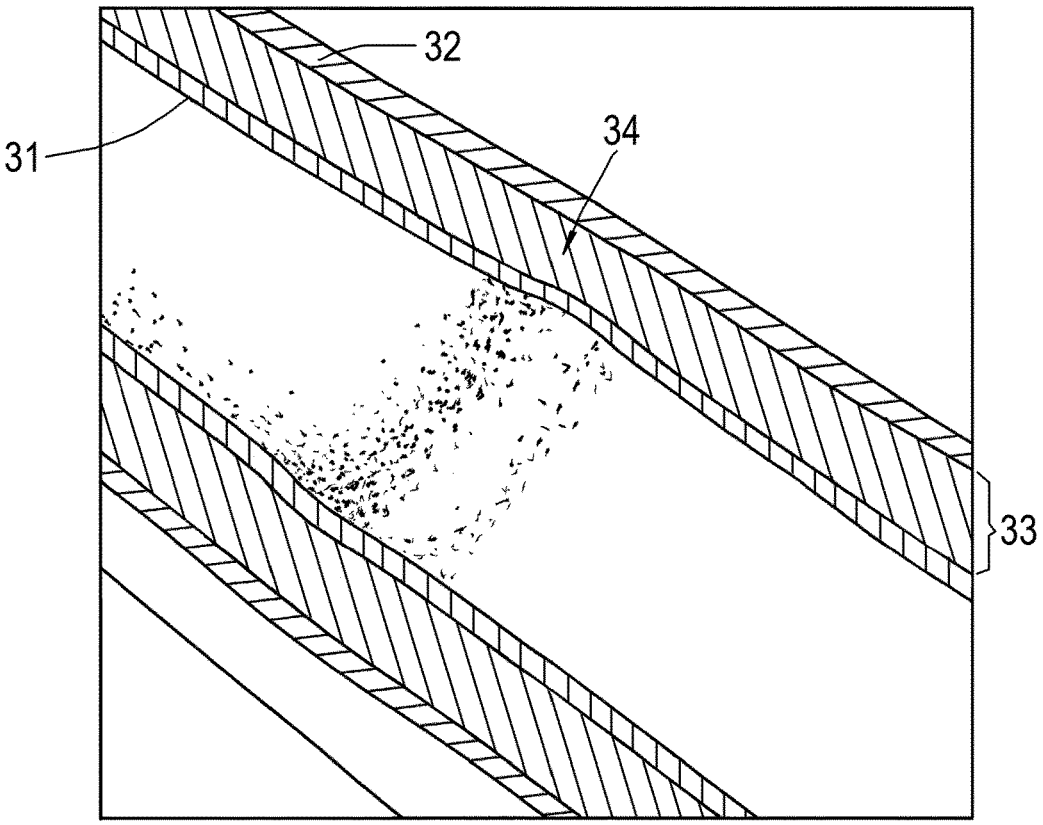
FIG. 6 shows a photograph of a sample cut open after inducing the local expansion.

After completion of the leak tests the sample was cut open longitudinally. FIG. 6 shows the exposed inner tubular 31, outer tubular 32 and cement sheath 33. The local annular expansion 34 of the inner tube can be clearly seen. No damage to the cement, such as cracks or crevices, was visible by the bare eye in the impacted zone. The cement sheath was deformed in the impacted zone, neatly following the shape of the outer surface of the inner tube.

The cement sheath was studied using MRI (magnetic resonant imaging). The cement density was estimated using Hounsfield units (HU). Hounsfield units represent a quantitative scale for radiodensity. Using the Hounsfield value one can make a comparison of the average material density per section. The Hounsfield values are calibrated X-ray linear attenuation coefficients, which are both dependent on material density and material composition. Applicant found a relative difference of 4.5% higher HU from cement in the impacted zone as compared to cement outside the impacted zone. Assuming the HU numbers are proportional to density, this shows the cement has plastically deformed and compactified.

It is thus believed that the method described herein involves sealing cavities in or adjacent to a cured cement sheath surrounding a wellbore tubular of an underground wellbore, as a result of strain imposed by a pressure wave of an energetic charge detonated within the wellbore.

The method is suitable for well integrity restoration operations, including but not limited to prevention of or reduction of surface casing vent flow and water shut off operations. The method may also be used in the context of decommissioning or abandonment of wells.

The person skilled in the art will understand that the present invention can be carried out in many various ways without departing from the scope of the appended claims.

I claim:

1. A method of remediating leaks in a cement sheath of cured cement surrounding a wellbore tubular in an underground wellbore, the method comprising the steps of:

providing an energetics device comprising at least one charge;

moving the energetics device to a selected depth in the wellbore tubular; and detonating the at least one charge to create an outwardly directed pressure wave over a full 360 radiation angle in a plane transverse to a longitudinal axis of the wellbore tubular at the location of the energetics device;

plastically deforming the wellbore tubular with the pressure wave at the selected depth thereby forming a circumferential recess into an inner surface of the wellbore tubular whereby forcing the outer surface of the wellbore tubular at the selected depth into the surrounding cement sheath.

2. The method of claim 1, wherein cavities in or adjacent to the cement sheath of cured cement are sealed as the outer surface of the wellbore tubular is forced into the surrounding cement sheath.

3. The method of claim 1, wherein plastically deforming the cement sheath under strain caused by said plastically deforming of the wellbore tubular into the surrounding cement sheath.

4. The method of claim 1, wherein a radiation pattern of the outwardly directed pressure wave as function of polar angle is centered around said plane and decreases with latitude, wherein latitude is defined relative to the plane.

5. The method of claim 1, wherein plastically deforming the wellbore tubular comprises locally straining the wellbore tubular to above yield point but below rupture point.

6. The method of claim 1, wherein the cement sheath fills up an annular space between the wellbore tubular and a surrounding support structure.

7. The method of claim 1, wherein the wellbore tubular is a casing cemented in place by said cement sheath.

8. The method of claim 7, wherein said casing is cemented in place against formation rock.

9. The method of claim 7, wherein said casing extends longitudinally through another casing and at least at the selected depth is cemented in place against the other casing.

10. The method of claim 9, wherein the other casing is cemented in place within the wellbore, as well.

* * * * *